United States Patent [19]

Frou et al.

[11] Patent Number: 4,586,356

[45] Date of Patent: May 6, 1986

[54] PROCESS AND APPARATUS FOR PREVENTING DISSYMMETRY IN ROLLED BEAMS

[75] Inventors: Pascal Frou, Vernon; Gilbert Krausener, Metz, both of France

[73] Assignee: Institut de Recherches de la Siderurgie Francaise (IRSID), Metz, France

[21] Appl. No.: 750,356

[22] Filed: Jul. 1, 1985

[30] Foreign Application Priority Data

Jul. 2, 1984 [FR] France ..... 84 10719

[51] Int. Cl.[4] ..... B21B 37/08

[52] U.S. Cl. ..... 72/8; 72/19; 72/225; 72/252

[58] Field of Search ..... 72/8, 19, 250, 252, 72/225

[56] References Cited

FOREIGN PATENT DOCUMENTS

| | | | |
|---|---|---|---|
| 56-717 | 5/1981 | Japan | 72/250 |
| 16612 | 1/1984 | Japan | 72/8 |
| 39405 | 3/1984 | Japan | 70/250 |

*Primary Examiner*—Francis S. Husar
*Assistant Examiner*—Jorji M. Griffin
*Attorney, Agent, or Firm*—Pollock, Vande Sande & Priddy

[57] ABSTRACT

Process and apparatus for preventing defects in the symmetry of rolled H-beams or I-beams, i.e., a faulty position of their webs (4) in relation to their flanges (5), by correcting such defects in situ. The differential between the torques applied to the upper and lower rolls (1,2) of the rolling stand is determined and compared to a predetermined threshhold value (δ). Any excess of the measured value over the threshhold value is eliminated by correction of the elevation of the inlet table of the rolling stand so as to reduce the measured value to below the threshhold value.

8 Claims, 5 Drawing Figures

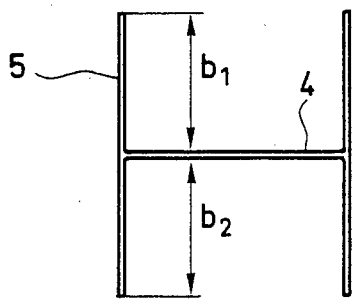
Fig. 1
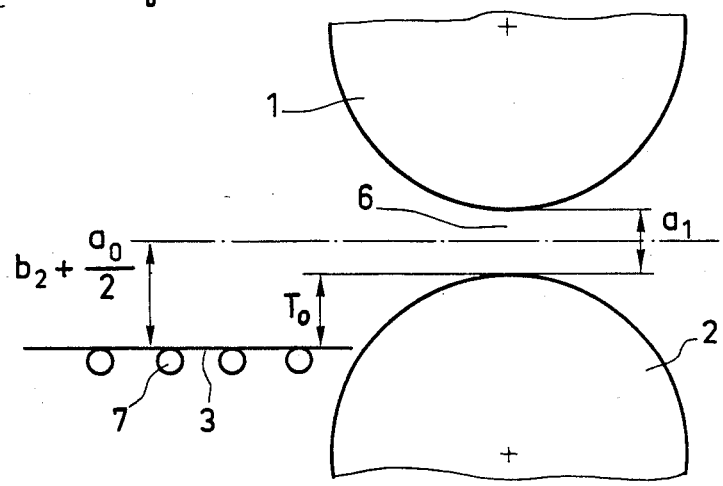
Fig. 2
Fig. 4
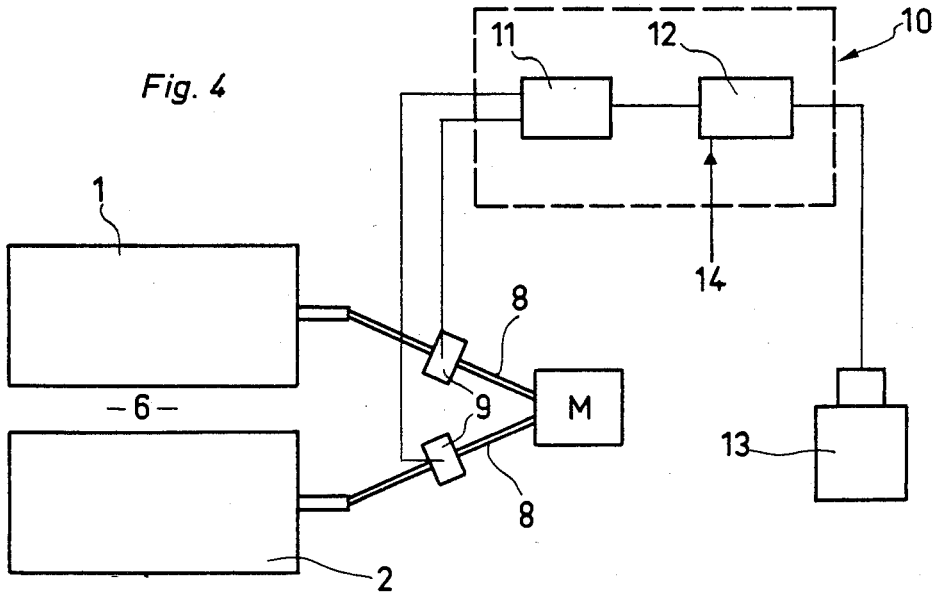

PROCESS AND APPARATUS FOR PREVENTING DISSYMMETRY IN ROLLED BEAMS

FIELD OF THE INVENTION

The present invention relates to the rolling of beams on universal mill stands, particularly of steel beams of the H or I type. More precisely, the invention relates to the prevention of defects in symmetry which may appear in such beams in the course of rolling.

BACKGROUND OF THE INVENTION

It is known that rolled beams of the type referred to are subject to the appearance of defects in symmetry, the most serious of which being a shift of the position of the web relative to the flanges of the structure, and which may make the beam unusable. For example, French Pat. No. 74/39798 shows that this problem has been under consideration for some time, but, despite the needs of industry in this regard, it appears that no satisfactory solution has been found to date. The normal practise has been to detect the occurrence of this type of defect, and to try to prevent its reappearance in the succeeding beam by an a priori correction of the relative elevation of the inlet table of the rolling stand before entry of the bar thereinto.

The present invention provides a preventive solution which enables a correction to be made during the rolling operation itself.

OBJECT OF THE INVENTION

To this effect, the present invention has for its object a process and apparatus for preventing defects in the symmetry of beams during rolling in a universal stand, according to which the elevation of the inlet table of the rolling stand is adjusted relative to that of the rolls.

In accordance with the invention, the torques applied to the upper and lower rolls are measured; a value representing the differential between the two torques is calculated, expressed as a pre-selected criterion of dissymmetry of said beams; this calculated value is compared with a predetermined reference value defining a limit differential threshhold tolerance, representing a maximum acceptance value of said dissymmetry criterion; and, if the absolute value of this calculated value is higher than the reference value, the elevation of the inlet table relative to that of the rolls is adjusted, such as to reduce said calculated value to below said reference value.

In one embodiment, the calculated value Δ representing the differential between the torques of the two rolls is determined in accordance with the relationship, in percentage terms, $$\Delta\% = \frac{200\,(Cs - Ci)}{Cs + Ci}$$

where Cs and Ci are the measured values of the torques of the upper and lower rolls, respectively.

Further in accordance with the invention, the apparatus for carrying out the described process comprises means for continuous measurement of the torques of the upper and lower rolls and for generating two signals representing the torques of the respective rolls; a calculating unit receiving these signals and generating a signal representing the value of the differential between the two torques; and a comparator one of those inlets is connected to the outlet of the calculating unit, its other inlet receiving a signal representing a limit differential reference value, and whose outlet is connected to a motor controlling the elevation of the inlet table relative to that of the rolls.

As will be understood, the invention consists of the discovery that it is possible to express the dissymmetry of the beams, caused by defective location of the web, in terms of the differential between the torque measurements applied to the two work rolls.

Furthermore, the invention comprises the recognition that there is a linear relationship between the criterion of dissymmetry of beams generally used, (i.e., the criterion d calculated according to the formula $$\frac{b1 - b2}{\frac{(b1 + b2)}{2}}$$

wherein b1 and b2 represent the heights of the two complementary flange halves) and a criterion relating to the torque differential between the rolls, defined by a completely analogous relationship in which the heights of the flange halves are replaced by the torque values. This relationship defining the torque criterion Δ is $$\Delta = \frac{Cs - Ci}{\frac{1}{2}(Cs + Ci)} \qquad \text{(I)}$$

in which Cs and Ci are the measured values of the respective torques of the upper and lower rolls. As a result, the simple measurement of the torques applied to the upper roll and the lower roll makes it possible to calculate Δ and to correct, if necessary, the relative elevation of the inlet table. Moreover, the adjustment can take place continuously during rolling.

BRIEF DESCRIPTION OF THE DRAWINGS

Other advantages and features of the invention will appear in the following description with reference to the accompanying drawings, in which an embodiment of the invention is shown for purposes of illustration, and in which:

FIG. 1 is schematic sectional elevation of a beam;

FIG. 2 is a schematic side view showing the relative positions of the horizontal rolls and of the inlet table;

FIG. 4 shows schematically, in longitudinal section, an embodiment of the invention.

DETAILED DESCRIPTION

Figure 3:
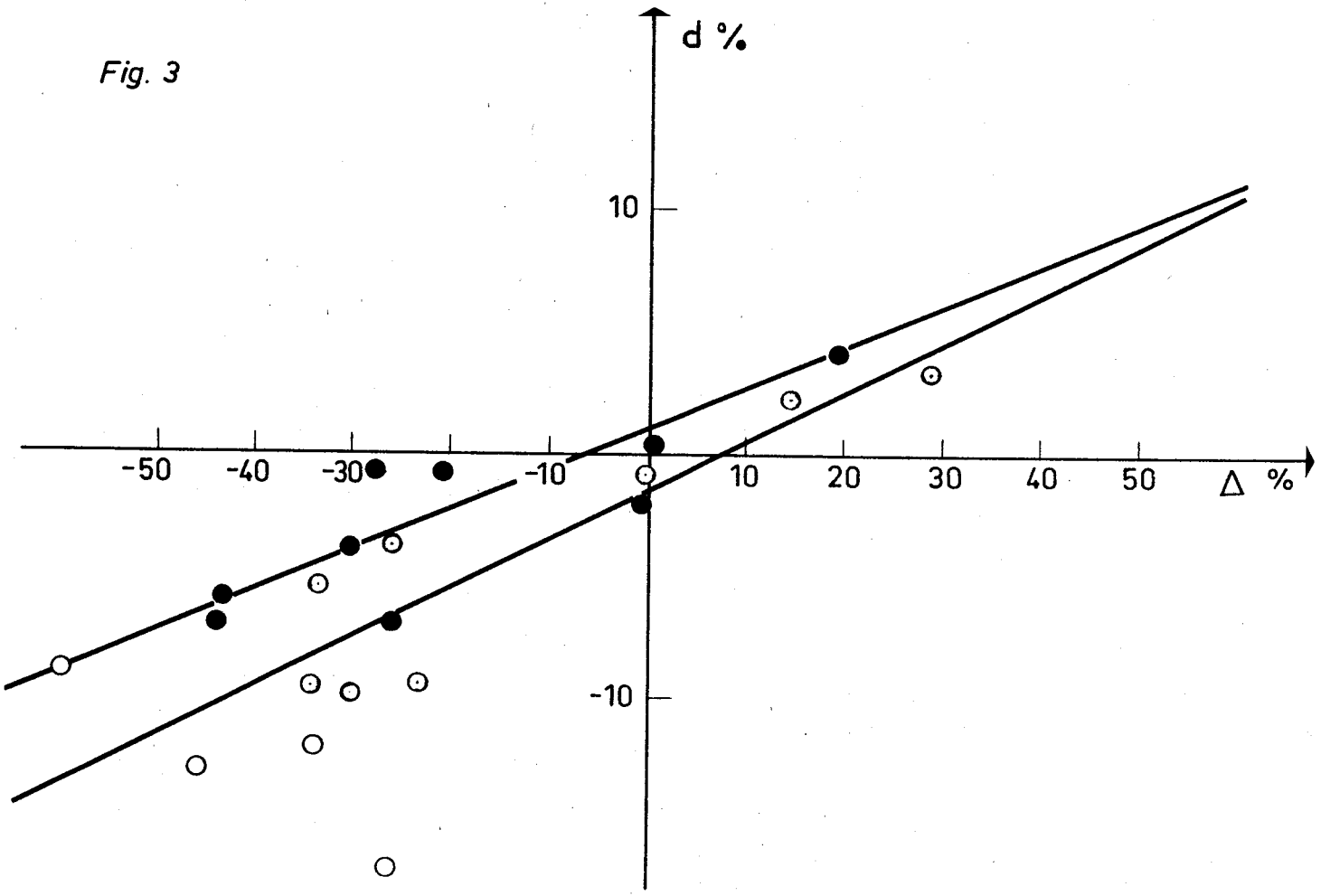
FIG. 3 shows graphically the linear relationship between the dissymmetry of the beam and the differential between the torques of the upper and lower rolls.

According to the example shown in FIG. 1, an H-beam 3 is constituted by a web 4 connecting at their centers two flanges 5. As was previously noted, b1 corresponds to the height of the upper flange halve and b2 corresponds to the height of the lower flange half. This roughed-down bar, which is not yet finished, is to be rolled, in accordance with the process of the invention, in a rolling mill partly shown schematically in FIG. 2. This rolling mill comprises two horizontal rolls 1 and 2, upper and lower respectively, which assure rolling of beam 3, which is led by the rollers 7 of the inlet table into an opening 6 having a width $a_1$ between rolls 1 and 2.

The inlet table is made movable in vertical translation by conventional means (not shown). The control of such movement will be described in detail hereinbelow.

Given what has already been described, and knowing that $a_o$ represents the thickness of the web 4 prior to rolling, and that T designates the vertical distance between the lower end of the flanges of the beam and the base of opening $a_1$, it can be deduced that symmetrical entry of the beam between rolls 1 and 2 corresponds to a distance $T=T_0$ with $$T_0 = b_2 + \frac{a_0}{2} - \frac{a_1}{2}.$$

Simple misadjustment of table 7 alters this distance T. If T is greater than $T_0$, the table is too low, and inversely, if T is less than $T_0$, the table is too high. This of course cause a defect in the symmetry of the rolled beam, resulting in a web 4 position shifted upwardly or downwardly, repectively, with respect to the mid-height line of flanges 5.

It has been discovered that there is a linear relationship between the dissymmetry criterion d of the beam as usually considered:

$$d\,\% = 100\,\frac{b1 - b2}{\frac{b1 + b2}{2}}$$

and a differential criterion Δ of the torques of rolls 1 and 2, expressed as $$\Delta\% = \frac{Cs - Ci}{\frac{Cs + Ci}{2}} \qquad \text{(I)}$$

It will be noted that these two variables are expressed in percentage terms.

FIG. 3 illustrates this linear relationship of dissymmetry d as a function of the torque differential Δ.

Different profile types have been sued to establish this relationship: The symbol o designates beams whose flanges are parallel (i.e., H-beams and I-beams), while the symbol ● corresponds to those whose flanges are inclined (i.e., beams of the type). As can be seen in FIG. 3, a linear relationship effectively exists between d and Δ. Furthermore, the sensitivity of the differential of torque Δ to adjustment of the relative position of the table is higher than that of dissymmetry d. Thus, FIG. 3 confirms that a dissymmetry of 2% can induce a torque differential of 5 to 15%.

It is easy to understand the interest in these results. First of all, the measurement of the torque differential is simple. And above all, such measurement can be made at any moment and continuously during rolling, so that defects in the rolling of the beams caused by poor height positioning of table 7 can be corrected immediately.

FIG. 4 shows an embodiment f apparatus for practising the process according to the invention. Rolling mill rolls 1 and 2 are driven in the conventional manner by a reduction motor M with the aid of spindles 8. Each spindle 8 is provided with a strain gauge device 9 connected to a calculation unit 10 which controls a reversible motor 13 actuating means (not shown) for adjusting the elevation of the inlet table. The strain gauge devices 9 transmit to unit 10 signals representing the measured value of the torques Cs and Ci applied to rolls 1 and 2. Unit 10 then calculates in a calculator 11 and signal corresponding to the differential Δ between the two calculated torques, using the relationship $$\Delta\% = 200\left(\frac{Cs - Ci}{Cs + Ci}\right) \qquad \text{(I)}$$

where Δ is expressed in percentage terms. The signal representing the calculated value Δ is then sent to a comparator 12 which, at its other inlet 14, receives a signal δ representing a limit reference differential value. In case the latter value is exceeded, the comparator sends a control signal to motor 13 in such manner as to bring back such value below the threshhold of reference δ. Experience has shown that very good results are obtained when the threshhold limit value does not exceed about 3%. Moreover below 1.3%, the effect on the symmetry of the beams is no longer noticeable.

Different methods well known in the art can be used for assuring the displacement of the table so as to reduce Δ below a reference threshhold. Of these, only two will be mentioned according to whether the absolute value of Δ (marked as | Δ | ) or its algebraic value is taken into account.

In the first case, a variation check of | Δ | will be provided between two successive measurements Δi and Δi+1. If the result of this check shows that | Δi+1 | is greater than | Δi | , one can deduce that the correction of the position of the table has been made in the wrong direction, and can then reverse the direction of motor 13.

The test device may simply be a comparator provided with a memory, located upstream, or preferably downstream of comparator 12. Its memory is first set at zero, and the first | Δi | higher than the reference threshhold is memorized and then replaced by | Δi+1 | after comparing | Δi+1 | to | Δi |.

In the second case, if the absolute calculated value of Δ is higher than threshhold δ, one takes into account the identity of the roll (upper or lower) whose torque value is deducted from that of the other in calculator 11, and one considers the sign of Δ in order to determine whether the table should be raised or lowered.

Thus, for example, if the result Δ of the calculation Cs-Ci, assuming it is above the thresshold, has a negative sign (i.e., if the torque applied to upper roll 1 is weaker than that applied to lower roll 2), this indicates that table 7 should be raised. Conversely, if Δ is positive, the table should be lowered. On the contrary, in calculating Ci-Cs, a negative sign for Δ will lead to lowering of the table, while a positive sign will lead to raising it.

If necessary, the elevation of the outlet table can be adapted to that of the inlet table in order not to impede the action of the latter.

Figure 5:
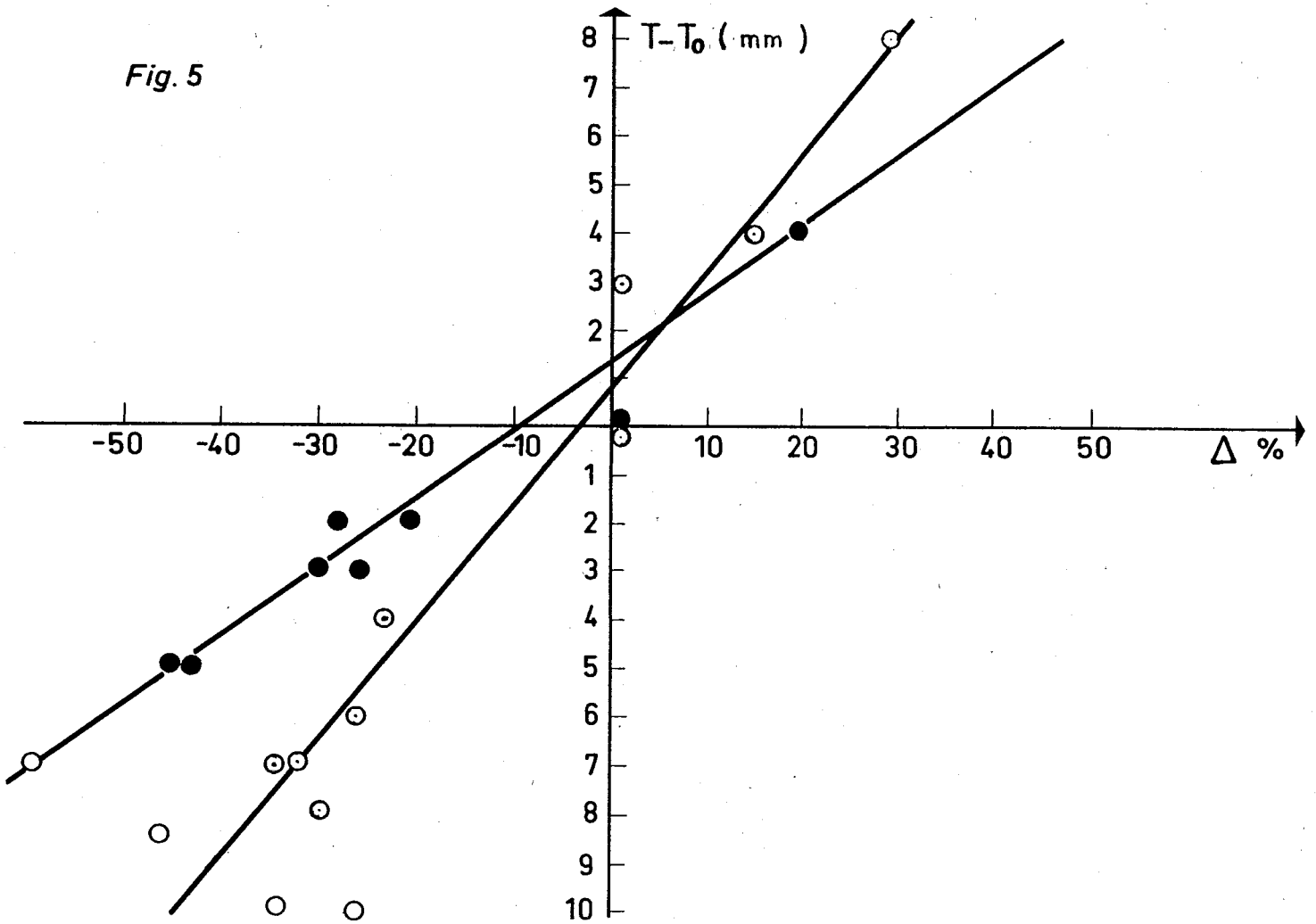
FIG. 5 shows graphically the tests performed and their results.

As can be seen in FIG. 5, which shows the relationship between adjustment of the table ($T-T_0$) and the torque differential Δ in percentage terms in the case of plasticine rolled on a model universal mill, a 1 mm deviation in the adjustment of the table can cause a torque differential of about 10%. The sensitivity is thus sufficiently high to permit precise adjustment of the relative elevation of inlet table 7.

Table I, which combines the results of numerous tests on the model mill, clearly shows the sensitivity of the measurement of torque differential Δ.

Furthermore, tests have been performed to show the evolution of the dissymmetry of a beam after several passes. To do this, the bar (reference 8H in the first column of Table I) was used to undergo further rolling treatments. As can be seen in Table I, for this bar 8H a torque differential Δ of −30% (fifth column) corresponds to a dissymmetry in the height of flanges d of −10% (column 8), with b1 equal to 43.5 mm (column 6) and b2 equal to 48 mm (column 7).

The bar, the height dissymmetry of whose flanges has thus been observed, was subjected to two different rolling treatments.

First, if was subjected to a pass in which the differential Δ between the torques applied to the rolls equals zero. After this test, it was observed that the dissymmetry of bar 8H remains. The bar was then subjected to a pass with a torque differential equal to +43%, i.e., a misadjustment of 8 mm inverse to that confirmed during the initial pass (column 2 of Table I). Following this test, it was observed that the dissymmetry has been practically eliminated. In effect, the results gave a criterion of dissymmetry equal to 2%, with b1 equal to 48 mm and b2 equal to 47 mm.

From these tests, it is clear that a defect in the symmetry of a beam appearing in the course of a pass can be corrected by effecting the following pass with a dissymmetrical misadjustment opposite to the one which produced the defect.

The advantage resulting from the invention is that it enables continuous control of the value of torque differential to be made, and that, through a simple, automatic device, it is possible during rolling to correct immediately any defects in the symmetry of the beams.

The adjustment of the relative elevation of the table can also be achieved by changing the elevation of the working rolls if the installation permits such a change. In this case, rolls 1 and 2 are mounted in vertically adjustable chocks, whose movement is conrolled by reversible motor 13.

Moreover, the means for measuring the torques of rolls 1 and 2 can be magnetic rings surrounding drive spindles 8. Obviously, other measuring means can also be used.

TABLE I

| Bar No. | Δ table adjustment | Upper torque | Lower torque | Δ % | Heights Upper | Heights Lower | d % |
|---|---|---|---|---|---|---|---|
| 2 X ● | 0 | 3,4 | 3,4 | 0 | 47,1 | 47,9 | −2 |
| 3 X ● | −3 | 3,0 | 3,9 | −26 | 46,2 | 49,5 | −7 |
| 4 X ● | +3 | 3,5 | 3,5 | 0 | 48,2 | 48,0 | +0,4 |
| 5 X ● | −3 | 2,0 | 2,7 | −30 | 47,5 | 49,5 | −4 |
| 6 X ● | −5 | 1,8 | 2,8 | −43 | 47,0 | 50,0 | −6 |
| 8 X ● | +4 | 5,8 | 4,8 | +19 | 49 | 47 | +4 |
| 9 X ● | −2 | 2,1 | 2,8 | −28 | 47,9 | 48,2 | −0,6 |
| 10 X ● | −2 | 2,5 | 3,1 | −21 | 47,9 | 48,2 | −0,6 |
| 11 X ● | −5 | 2,3 | 3,6 | −44 | 46,8 | 49,8 | −7 |
| 1 H ○ | −7 | 2,4 | 3,4 | −34 | 44,5 | 47 | −5,5 |
| 2 H ○ | 0 | 2,6 | 2,6 | 0 | 46 | 46,5 | −1,0 |
| 3 H ○ | +4 | 3,1 | 2,7 | 14,0 | 47 | 46 | +2,2 |
| 4 H ○ | +8 | 4,4 | 3,3 | 28,6 | 47 | 45,5 | +3,3 |
| 5 H ○ | −7 | 2,7 | 3,8 | −34 | 44,5 | 49 | −9,6 |
| 6 H ○ | −4 | 2,75 | 3,45 | −23 | 44 | 48,5 | −9,7 |
| 7 H ○ | −6 | 2,7 | 3,5 | −26 | 45 | 46,8 | −3,9 |
| 8 H ○ | −8 | 2,6 | 3,5 | −30 | 43,5 | 48 | −10 |
| A ○ | −8,5 | 3,5 | 5,6 | −46 | 43,5 | 49,5 | −13 |
| B ○ | −7 | 1,5 | 2,8 | −60 | 43,3 | 47,4 | −9,0 |
| C ○ | −10 | 5,75 | 7,50 | −26 | 43,5 | 51,5 | −17 |
| D ○ | +10 | 5,7 | 4,8 | +17 | 52,5 | 42,0 | +22 |
| E ○ | −10 | 4,25 | 6,0 | −34 | 44,5 | 50 | −12 |

What is claimed is:

1. Process of preventing defects in the symmetry of beams during rolling in a universal stand in which the elevation of an inlet table (7) of a rolling mill is adjusted relative to that of operating rolls (1, 2) of said stand, comprising the steps of:

(a) effecting a measurement of the torques applied to an upper (1) and a lower (2) roll of said stand;

(b) calculating from said measurement a value representing the differential between said torques expressed as a preselected criterion of dissymmetry of said beams;

(c) comparing said calculated value to a predetermined reference value (δ) defining a limit differential threshhold tolerance, representing a maximum acceptable value of said dissymmetry criterion; and (d) if the absolute value of said calculated value is higher than said reference value, altering the elevation of said inlet table (7) relative to that of said operating rolls (1, 2) to reduce said calculated value to below said reference value (δ).

2. Process according to claim 1, wherein said calculated value is determined in accordance with the relationship, expressed in percentage terms, as $$\Delta\% = \frac{200\,(Cs - Ci)}{Cs + Ci}$$

wherein Cs and Ci are the measured values of said upper and lower rolls, respectively.

3. Process according to claim 1, wherein said threshhold tolerance is in the range of 1.5% and 3.0%.

4. Apparatus for preventing defects in the symmetry of beams during universal rolling in which the elevation of an inlet table (7) of a mill stand is adjusted relative to that of operating rolls (1, 2) of said stand, comprising (a) means (9) for continuous measurement of the torques of upper (1) and lower (2) rolls of said stand and for generating two signals representing the torques of the respective rolls;

(b) a calculating unit (11) receiving said signals and generating a signal representing the value of the differential between the two torques;

(c) a comparator (12) one of whose inlets is connected to an outlet of said calculating unit, the other of its inlets receiving a signal (δ) representing a limit differential reference value, and whose outlet is connected to a reversible motor (13) controlling the elevation of said inlet table (7) relative to that of said rolls (1, 2).

5. Apparatus according to claim 4, wherein said inlet table is movably mounted for vertical translation, and wherein said reversible motor (13) controls the adjustment of its elevation.

6. Apparatus according to claim 4, wherein at least one of said rolls (1, 2) is mounted in vertically adjustable chocks, and wherein said reversible motor (13) controls the elevation of said chocks.

7. Apparatus according to claim 4, wherein said means for measurement of the torques of said upper (1) and lower (2) rolls are strain gauge devices (9) located on spindles (8) of said rotating rolls.

8. Apparatus according to claim 4, wherein said means (9) for torque measurement are magnetic rings surrounding spindles (8) of said rotating rolls (1, 2).

* * * * *